US006158851A

United States Patent [19]

Zepeda

[11] Patent Number: 6,158,851

[45] **Date of Patent: *Dec. 12, 2000**

[54] INK VALVE HAVING A RELEASABLE TIP FOR A PRINT CARTRIDGE RECHARGE SYSTEM

[75] Inventor: Alfred Zepeda, San Marcos, Calif.

[73] Assignee: Hewlett-Packard Company, Palo Alto, Calif.

[ * ] Notice: This patent is subject to a terminal disclaimer.

[21] Appl. No.: 09/191,837

[22] Filed: Nov. 13, 1998

Related U.S. Application Data

[63] Continuation of application No. 08/618,238, Mar. 14, 1996, Pat. No. 5,886,719.

[51] Int. Cl.[7] ..... B41J 2/175

[52] U.S. Cl. ..... 347/85

[58] Field of Search ..... 347/29, 86, 85

[56] References Cited

U.S. PATENT DOCUMENTS 5,886,719 3/1999 Zepeda ..... 347/85

*Primary Examiner*—John Barlow
*Assistant Examiner*—Charles W. Stewart, Jr.
*Attorney, Agent, or Firm*—Jerry R. Potts

[57] ABSTRACT

An ink printing system is described herein which includes a print cartridge, having an ink reservoir and an ink fill hole, and an ink refill system for engaging the print cartridge's ink fill hole and transferring ink to the ink reservoir. The ink fill hole has a stopper blocking the hole to prevent ink leakage through the hole. The ink refill system containing a supply of ink has a male valve, resembling a hollow needle, which is inserted through the ink fill hole and pushes the stopper into the ink bag. The male valve creates an airtight fluid communication path between the print cartridge and the ink supply in the ink refill system. Ink is then transferred from the ink refill system into the print cartridge. The ink refill system is then removed from the print cartridge. The male valve of the ink refill system has a releasable tip which is pulled into the ink fill hole to seal the ink fill hole. The tip is then released from the male valve such as by unscrewing the male valve from the tip.

8 Claims, 14 Drawing Sheets

INK VALVE HAVING A RELEASABLE TIP FOR A PRINT CARTRIDGE RECHARGE SYSTEM

CROSS REFERENCE TO RELATED APPLICATION

This is a continuation of application Ser. No 08/618,238 filed on March 14, 1996 now U.S. Pat. No. 5,886,719.

FIELD OF THE INVENTION

This invention relates to inkjet printers and, more particularly, to a technique for refilling inkjet print cartridges with ink.

BACKGROUND OF THE INVENTION

A popular type of inkjet printer contains a scanning carriage for supporting one or more disposable print cartridges. Each disposable print cartridge contains a supply of ink in an ink reservoir, a printhead, and ink channels which lead from the ink reservoir to ink ejection chambers formed on the printhead. An ink ejection element, such as a heater resistor or a piezoelectric element, is located within each ink ejection chamber. The ink ejection elements are selectively fired, causing a droplet of ink to be ejected through a nozzle overlying each activated ink ejection chamber so as to print a pattern of dots on the medium. When such printing takes place at 300 dots per inch (dpi) or greater, the individual dots are indistinguishable from one another and high quality characters and images are printed.

Once the initial supply of ink in the ink reservoir is depleted, the print cartridge is disposed of and a new print cartridge is inserted in its place. The printhead, however, has a usable life which outlasts the ink supply. Methods have been proposed to refill these single-use-only print cartridges, but such refilling techniques require penetration into the print cartridge body in a manner not intended by the manufacturer and typically require the user to manually inject the ink into the print cartridge. Penetration into the cartridge body typically opens the print cartridge ink bag to the atmosphere, and any back pressure within the ink bag is lost. Additionally, the quality of the refill ink is usually lower than the quality of the original ink. As a result, such refilling frequently results in ink drooling from the nozzles, a messy transfer of ink from the refill kit to the print cartridge reservoir, air pockets forming in the ink channels, poor quality printing resulting from the ink being incompatible with the high speed printing system, and an overall reduction in quality of the printed image.

What is needed is an improved structure and method for recharging the ink supply in an inkjet print cartridge which is not subject to any of the above-mentioned drawbacks of the existing systems.

SUMMARY

An ink printing system is described herein which includes a print cartridge, having an ink reservoir and an ink fill hole, and an ink refill system for engaging the print cartridge's ink fill hole and transferring ink to the ink reservoir.

In a preferred embodiment, the ink reservoir in the print cartridge consists of a spring-loaded collapsible ink bag, where the spring urges the sides of the ink bag apart and thus maintains a negative pressure within the ink bag relative to ambient pressure. This negative pressure prevents ink drooling from the nozzles. As the ink is depleted during use of the print cartridge, the ink bag progressively collapses and overcomes the spring force.

An ink fill hole extends through the print cartridge body and into the ink bag. This ink fill hole is used by the manufacturer when initially filling the ink bag with ink. The ink fill hole has a stopper blocking the hole to prevent ink leakage through the hole.

An ink refill system containing a supply of ink has a male valve, resembling a hollow needle, which is inserted through the ink fill hole and pushes the stopper into the ink bag. The male valve creates an airtight fluid communication path between the ink bag and the ink supply in the ink refill system.

The negative pressure within the print cartridge ink bag then draws the ink from the ink refill system into the ink bag until the ink bag is substantially full. The ink refill system is then removed from the print cartridge. The male valve of the ink refill system has a releasable tip which is pulled into the ink fill hole to seal the ink fill hole. The tip is then released from the male valve such as by unscrewing the male valve from the tip. Thus, the negative pressure in the ink bag is maintained. The print cartridge may again be used for printing. The tip can be reused for subsequent rechargings.

DETAILED DESCRIPTION OF THE PREFERRED EMBODIMENTS

Description of Print Cartridge 10

Figure 1:
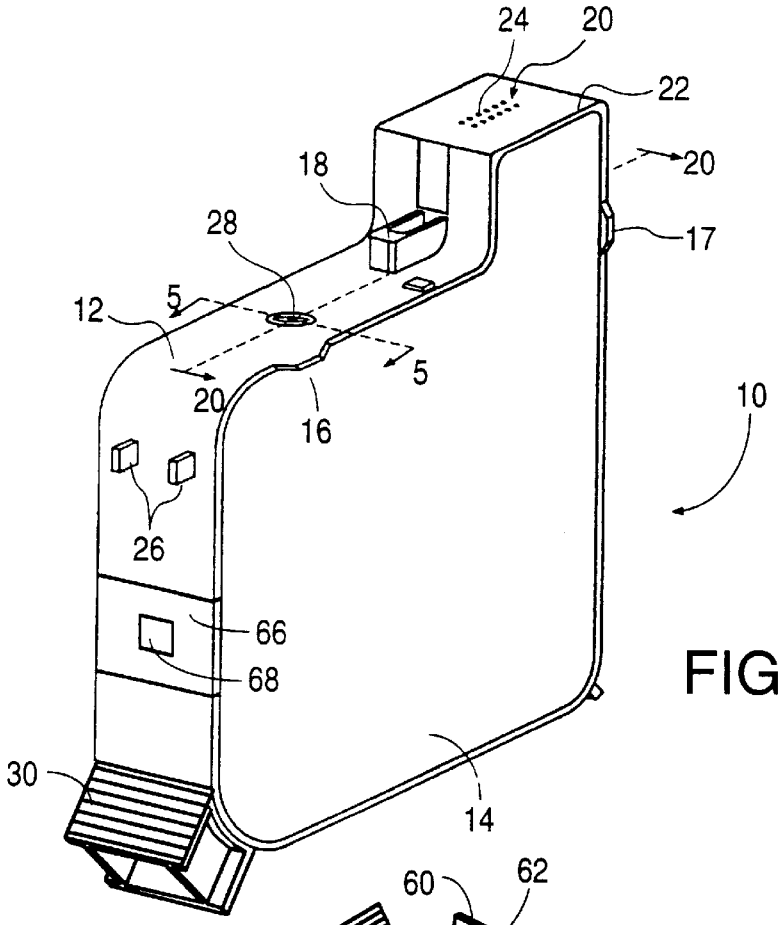
FIG. 1 is a perspective view of the preferred embodiment print cartridge incorporating an ink fill hole.

FIG. 1 shows one perspective view of the preferred embodiment print cartridge 10. Elements labeled with the same numerals in other figures are identical. The outer frame 12 of print cartridge 10 is formed of molded engineering plastic, such as the material marketed under the trademark "NORYL" by General Electric Company. Side covers 14 may be formed of metal or plastic. Datums 16, 17 and 18 affect the position of print cartridge 10 when installed in a carriage in an inkjet printer. Datums 16, 17 and 18 are machined after the nozzle member 20 has been installed on print cartridge 10 to ensure that all four print cartridges 10 (black and three primary color cartridges) installed in the same carriage have their respective nozzles aligned with each other. Additional detail regarding the formation of datums 16, 17 and 18 can be found in U.S. Pat. No. 5,408,746, entitled "Datum Formation for Improved Alignment of Multiple Nozzle Members in a Printer," assigned to the present assignee and incorporated herein by reference.

In the preferred embodiment, nozzle member 20 consists of a strip of flexible tape 22 having nozzles 24 formed in the tape 22 using laser ablation. One method for forming such nozzles 24 is described in U.S. Pat. No. 5,305,015, entitled "Laser Ablated Nozzle Member for Inkjet Printhead," by Christopher Schantz et al., assigned to the present assignee and incorporated herein by reference.

Plastic tabs 26 are used to prevent a particular print cartridge 10 from being inserted into the wrong slot in the carriage. Tabs 26 are different for the black, cyan, magenta, and yellow print cartridges.

A fill hole 28 is provided for initially filling the ink reservoir in print cartridge 10 by the manufacturer. This hole 28 is later sealed with a steel ball, which was previously intended to be permanent. Such filling will be described later.

A handle 30 facilitates insertion of print cartridge 10 into, and removal of print cartridge 10 from, the carriage.

Figure 2:
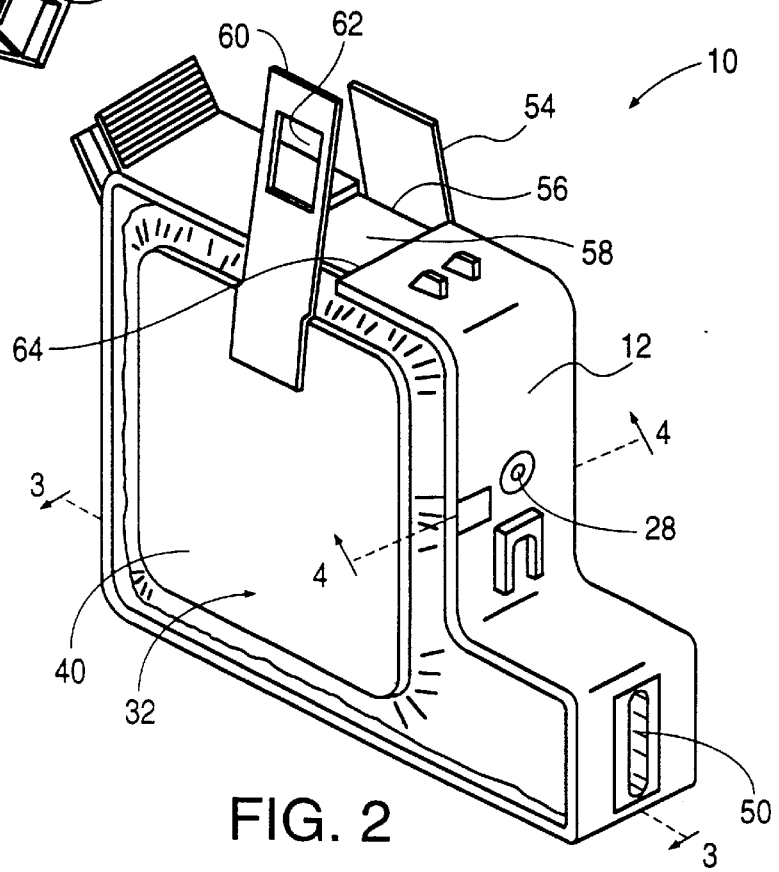
FIG. 2 is a perspective view of the print cartridge of FIG. 1 after assembly and prior to side covers being connected.
Figure 3:
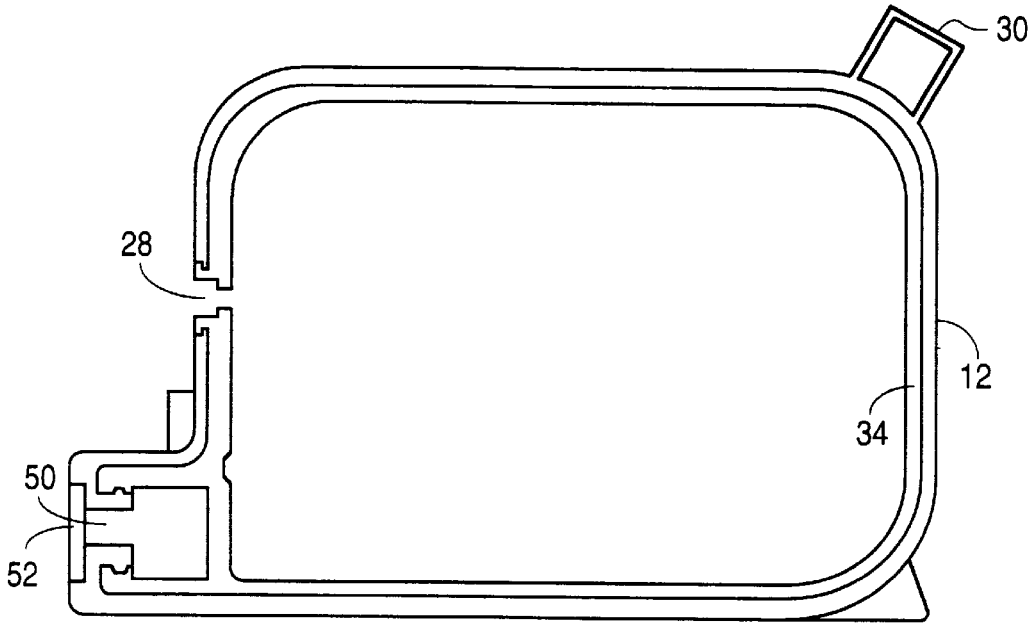
FIG. 3 is a cross-sectional view of the print cartridge of FIG. 2 taken along line 3—3 in FIG. 2.
Figure 4:
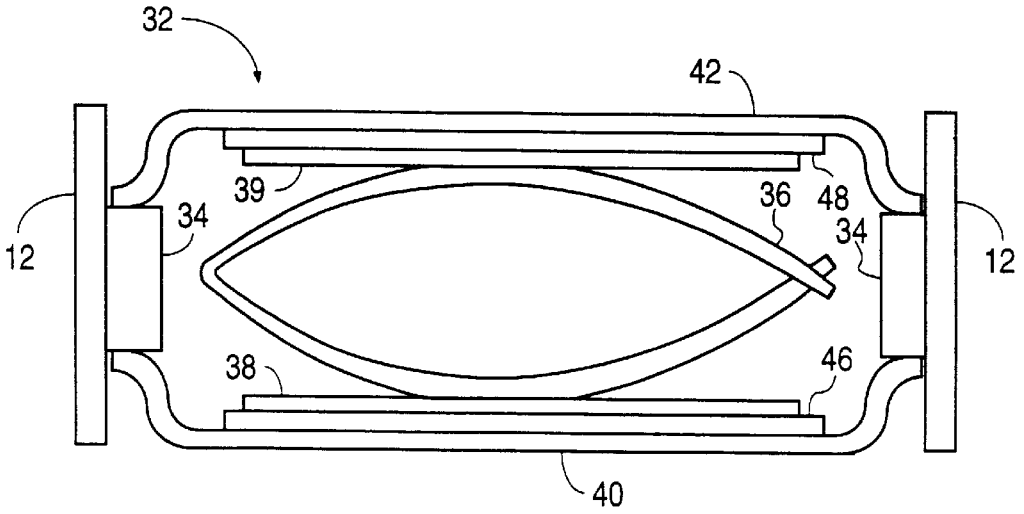
FIG. 4 is a cross-sectional view of the print cartridge of FIG. 2 taken along line 4—4 in FIG. 2.

FIG. 2 is a view of print cartridge 10 of FIG. 1 without side covers 14. FIGS. 3 and 4 are cross-sections of print cartridge 10 taken along line 3—3 and 4—4, respectively, in FIG. 2.

FIG. 2 shows the collapsible ink bag 32, which provides a negative internal pressure relative to atmospheric pressure. The construction of ink bag 32 is as follows.

A plastic inner frame 34 (FIG. 3) is provided which generally has the same contours as the rigid outer frame 12. Inner frame 34 is preferably formed of a plastic which is more flexible than that used to form outer frame 12 and has a lower melting temperature. A suitable plastic material is a soft polyolefin alloy. In the preferred embodiment, outer frame 12 is used as a portion of the mold when forming inner frame 34. Additional detail regarding the formation of frame 12 and frame 34 is found in U.S. application Ser. No. 07/994,807, filed Dec. 22, 1992, entitled "Two Material Frame Having Dissimilar Properties for a Thermal Ink-Jet Cartridge," by David Swanson, assigned to the present assignee and incorporated herein by reference.

A bow spring 36 (FIG. 4) is provided, which may be cut from a strip of metal such as stainless steel. The apexes of the bight portions of bow spring 36 are spot welded or laser welded to a central portion of rigid metal side plates 38 and 39. A pair of flexible ink bag sidewalls 40 and 42 (FIG. 4), formed of a plastic such as ethylene vinyl acetate (EVA) or Mylar, have their peripheral portions heat welded to the edges of inner frame 34 to provide a fluid seal and have their central portions heat welded to side plates 38 and 39. The preferred sidewalls 40 and 42 are formed of a flexible nine-layer material described in U.S. Pat. No. 5,450,112, incorporated herein by reference.

The ink bag sidewalls 40 and 42 now oppose side plates 38 and 39 so as to pretension bow spring 36. Bow spring 36 now acts as a pressure regulator to provide a relatively constant outward force on the ink bag sidewalls 40 and 42 to provide a negative pressure on the order of −0.1 psi within ink bag 32 (equivalent to a relative pressure of about −3 inches of water). An acceptable negative pressure is in the range of approximately −1 to −7 inches of water, with the preferred range being −3 to −5 inches of water.

The actual negative pressure required of ink bag 32 is based on various factors, including the nozzle orifice architecture, the geometry of print cartridge 10 (including the outer expansion limits of ink bag 32 as determined by the thickness of print cartridge 10), and the horizontal/vertical orientation of print cartridge 10 when mounted in a printing position in a carriage.

As ink is withdrawn from print cartridge 10, ink bag 32 will collapse.

Edge guards 46 and 48 (FIG. 4) may optionally be bonded to the surface of metal side plates 38 and 39 to prevent the metal edges of plates 38 and 39 from contacting and tearing the ink bag sidewalls 40 and 42. Each edge guard may be a thin plastic cover layer adhesively secured to the outer face of side plates 38 and 39 and slightly overlapping the edges.

A mesh filter (not shown) is also provided on inner frame 34 within ink bag 32 to filter out particles prior to the ink reaching the primary ink channel 50 (FIG. 2) formed in the snout portion of outer frame 12. A printhead assembly 52 (FIG. 3) will later be secured to the snout portion of print cartridge 10, and ink channels in the printhead assembly 52 will lead from the primary ink channel 50 into ink ejection chambers on the printhead.

Ink bag 32 is thus now completely sealed except for ink fill hole 28 and the opening for the primary ink channel 50.

In the preferred embodiment, the amount of ink remaining in ink bag 32 is ascertained by means of an ink level detector, illustrated in FIGS. 1 and 2, formed as follows. A first paper strip 54 of a solid color, such as green, is secured to ink bag sidewall 42 via an adhesive. The end of this strip 54 is then bent over the recessed edge 56 of frame 12 and lies flat against recessed surface 58 of frame 12. A strip 60 of a different color, such as black, is provided with a window 62. An adhesive on strip 60 is then secured to sidewall 40. Strip 60 is bent over the recessed edge 64 of frame 12 and now overlies strip 54 on the recessed surface 58. Once the side plates 14 (FIG. 1) are secured to print cartridge 10, a strip 66 (FIG. 1) having a transparent window 68, which may be a hole or a clear portion, is then secured over the recessed surface 58 by adhesively securing strip 66 to the respective side covers 14 on print cartridge 10. As the flexible ink bag sidewalls 40 and 42 become closer together as ink is depleted from ink bag 32, the window 62 in strip 60 will expose less and less of the color of strip 54, as seen through window 68, until the green color of strip 54 is no longer exposed through window 68 and only the black strip 60 appears through window 68. Print cartridge 10 must then be recharged using ink fill hole 28 and the method described later.

Additional information regarding the construction of the spring-loaded ink bag can be found in U.S. application Ser. No. 08/454,975, filed May 31, 1995, entitled "Continuous Refill of Spring Bag Reservoir in an Ink-Jet Swath Printer/Plotter," by Joseph Scheffelin et al., HP Case No. 10950576-1, assigned to the present assignee and incorporated herein by reference.

Other suitable negative pressure ink reservoirs include a plastic bellows, an ink bag have an external spring, a reservoir having an external pressure regulator, and a rigid reservoir whose internal pressure is regulated by a bubble source.

The preferred printhead assembly 52 (FIG. 3) is described in U.S. Pat. No. 5,278,584, entitled "Ink Delivery System for an Inkjet Printhead," by Brian Keefe et al., assigned to the present assignee and incorporated herein by reference. Additional information regarding this particular printhead structure may be obtained from U.S. application Ser. No. 08/319,896, filed Oct. 6, 1994, entitled "Inkjet Printhead Architecture for High Speed and High Resolution Printing," by Brian Keefe et al., assigned to the present assignee and incorporated herein by reference.

Figure 5:
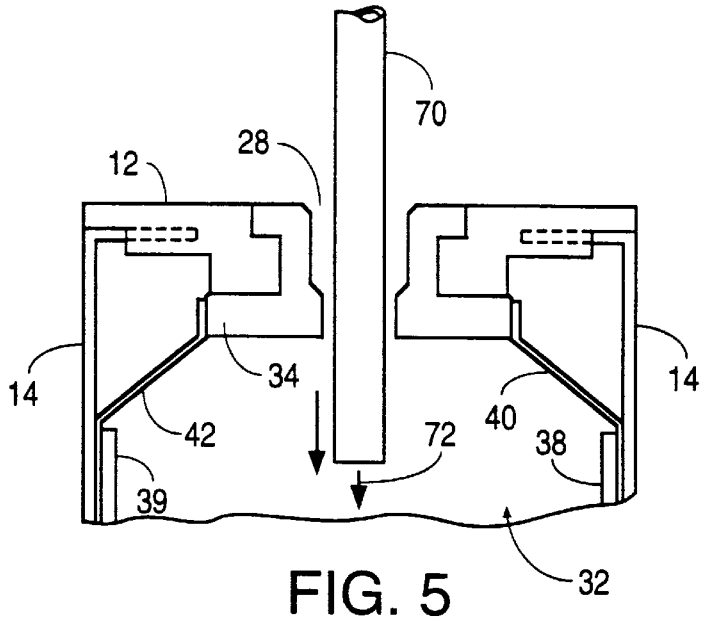
FIG. 5 is a cross-sectional view of the print cartridge of FIG. 1 taken along line 5—5 in FIG. 1 illustrating the initial filling of the print cartridge with ink.
Figure 6:
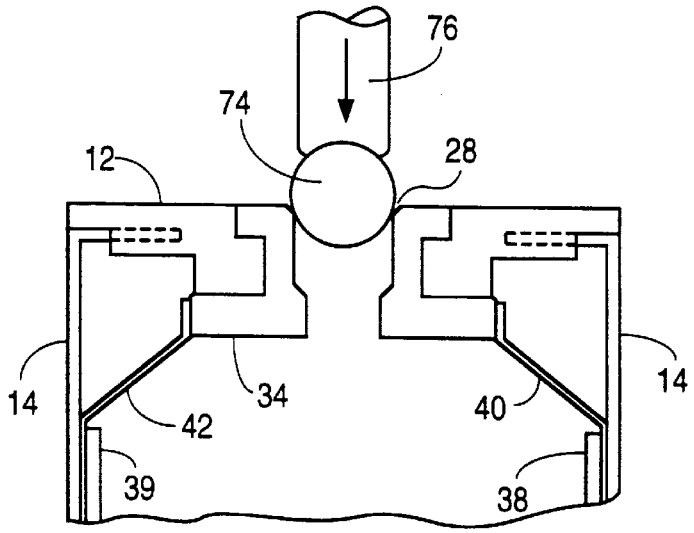
FIGS. 6 and 7 illustrate the insertion of a steel ball in the ink fill hole for sealing the fill hole.
Figure 7:
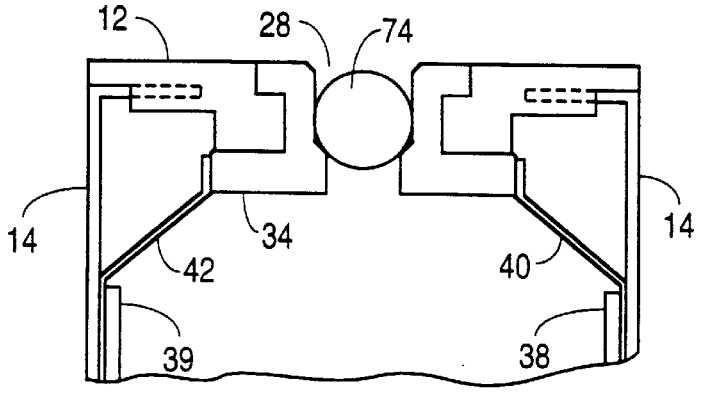

FIGS. 5–7 illustrate the preferred method of initially filling print cartridge 10 with ink through ink fill hole 28, best shown in FIG. 1. FIGS. 5–7 are taken along line 5—5 in FIG. 1 and show outer frame 12, side covers 14, inner frame 34, flexible ink bag sidewalls 40 and 42, and metal side plates 38 and 39. In a first step, the air in ink bag 32 is replaced with $CO_2$ by simply injecting $CO_2$ through ink fill hole 28. As described later, the $CO_2$ helps prevent air bubbles from forming in ink bag 32 after filling with ink. An ink delivery pipe 70 is then inserted through ink fill hole 28, and ink 72 is pumped into the empty ink bag 32 until the ink reaches fill hole 28. In the preferred method, pipe 70 is inserted to near the bottom of ink bag 32 to minimize ink splashing and the creation of foam.

Once ink bag 32 is full, a stainless steel ball 74 (FIG. 6) is pressed into ink fill hole 28 by a plunger 76 until ball 74 is seated and firmly secured in fill hole 28, as shown in FIG. 7. Ball 74 now seals ink fill hole 28.

Print cartridge 10 is then positioned such that its snout is at the highest point, and any excess air is withdrawn through nozzles 24 (FIG. 1) using a vacuum pump sealed with respect to nozzles 24. A sufficient amount of ink is then sucked through nozzles 24 to create the initial negative pressure in ink bag 32 equivalent to about −3 to −4 inches of water. Due to the small diameter of nozzles 24 and the narrow width of the various ink channels, coupled with the ink viscosity, the negative pressure within ink bag 32 does not draw air through nozzles 24. In the preferred embodiment, the capacity of ink bag 32 is around 50 milliliters.

The completed print cartridge 10 is then inserted into a sliding carriage in an inkjet printer and used in a conventional manner until ink bag 32 becomes progressively depleted, starting from an expanded state to a compressed state, all the time maintaining a negative pressure in ink bag 32.

Description of Ink Refill Systems

Preferred devices for recharging print cartridge 10 via ink fill hole 28 (or another ink fill hole) will now be described.

The various ink refill systems disclosed herein have a male valve which is used to press any stopper initially blocking ink fill hole 28 into ink bag 32 while maintaining an airtight fluid seal between the external-ink reservoir and ink bag 32. The ink bag 32 is then recharged. When the ink refill system is withdrawn, the original stopper or a new stopper releasably secured to the tip of the male valve is automatically pulled back into ink fill hole 28 to seat the stopper within ink fill hole 28. The stopper is then released from the ink refill system. Various embodiments of such an ink refill system are described below.

Figure 8:
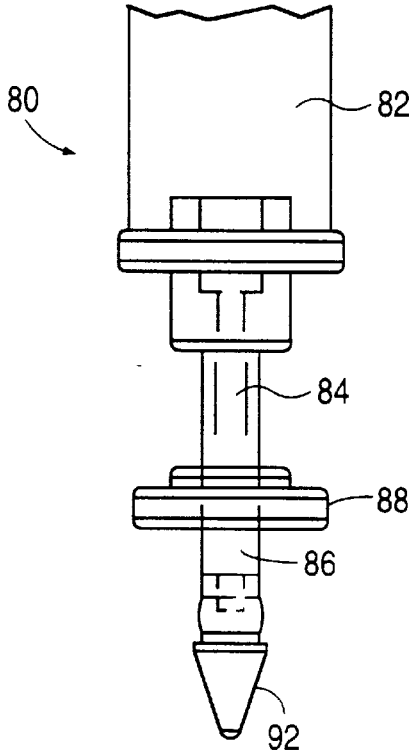
FIG. 8 is a side view of the valve portion of an ink refill system for recharging the print cartridge of FIG. 1.

In FIG. 8, an ink refill system 80 is provided with an ink reservoir 82 containing ink. This reservoir 82 can take virtually any form. Ink reservoir 82 is in fluid communication with the hollow central bore 84 of a male valve 86. Although the central bore 84 of valve 86 would normally be obscured, the partial outline of this bore 84 is illustrated in FIG. 8.

Figure 9:
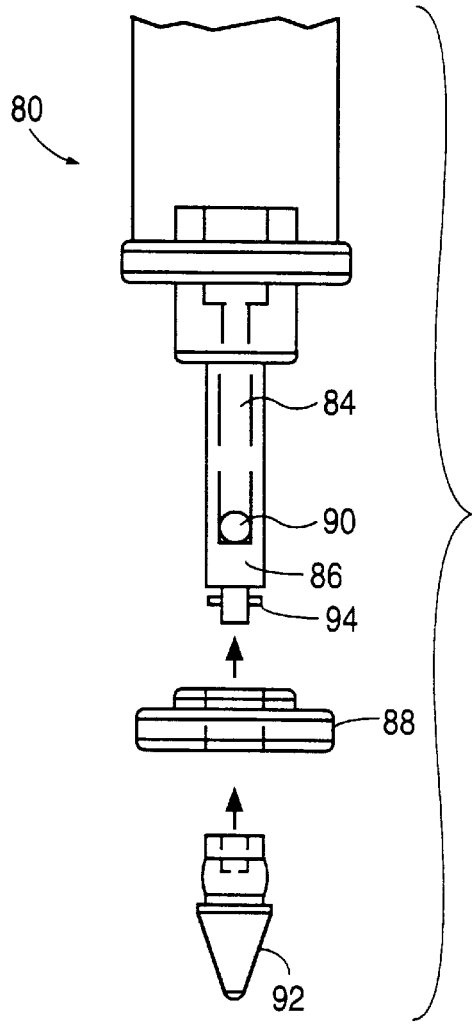
FIG. 9 is an exploded view of the ink refill system of FIG. 8.

A rubber sleeve 88 is frictionally fastened over a hole formed in valve 86 which extends into the central bore 84. This hole is shown as hole 90 in FIG. 9, which is an exploded view of ink refill system 80.

A separate valve tip 92 is connected to valve 86 by a screw thread 94 (FIG. 9) mating with internal threads in tip 92 or by other releasable securing means. In one embodiment, interlocking fins are used instead of threads to allow a release with only one-quarter turn. Suitable snap type couplings are also contemplated. Any suitable method of releasably securing tip 92 to the end of valve 86 to allow tip 92 to be attached and then detached is contemplated by this invention.

Valve 86 and tip 92 may be metal or plastic. The preferred length of valve 86 is on the order of one inch, but other lengths would also be suitable. The outside diameter of valve 86 should be slightly greater than the diameter of fill hole 28. In one embodiment, the diameter of valve 86 is about 0.18 inch.

Figure 10:
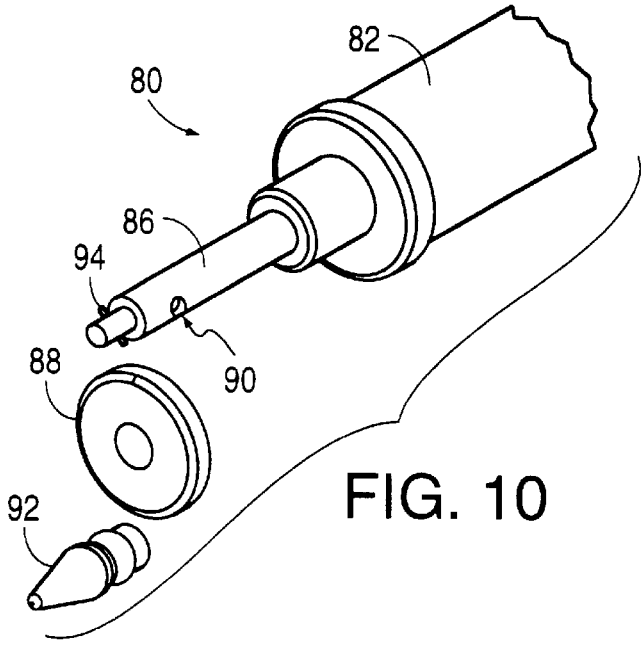
FIG. 10 is a perspective exploded view of the ink refill system of FIG. 8.

FIG. 10 is a perspective view of the parts making up the valve portion of ink refill system 80.

FIGS. 11–14 illustrate the method of using ink refill system 80 to recharge the depleted ink bag 32 in print cartridge 10.

Figure 11:
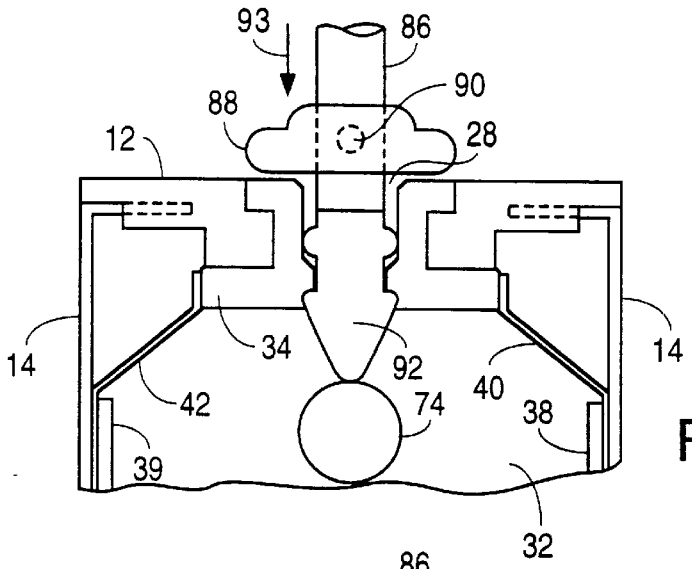
FIG. 11 is a cross-sectional view along line 5—5 in FIG. 1 showing the insertion of a valve into the ink fill hole of the print cartridge of FIG. 1.

In FIG. 11, which is a cross-sectional view along line 5—5 in FIG. 1, ink refill system 80 is brought together with print cartridge 10 so that tip 92 provides a force on steel ball 74 initially seated in ink fill hole 28. This force pushes ball 74 through hole 28 and into ink bag 32. The movement of valve 86 is shown by arrow 94 in FIG. 11. Since inner frame 34 is formed of a relatively soft plastic, the walls of hole 28 deform to allow tip 92 to pass through hole 28.

Figure 12:
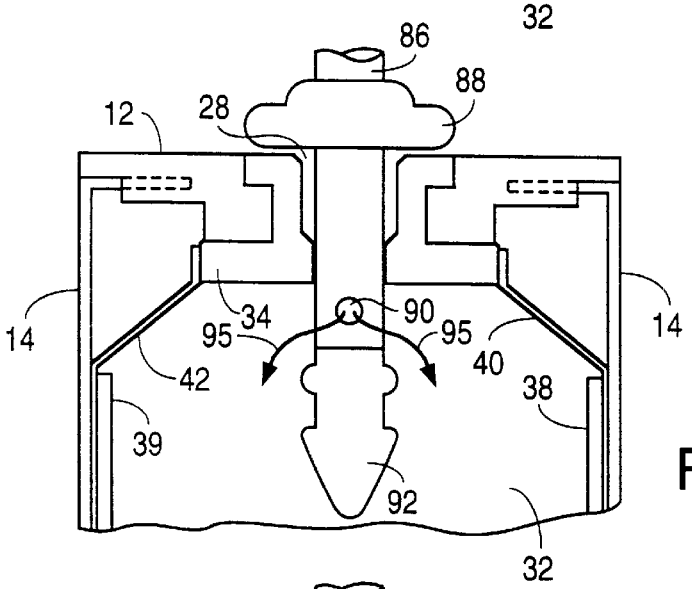
FIGS. 12, 13 and 14 illustrate the techniques used to recharge the print cartridge of FIG. 1 and to reseal the negative pressure ink bag within the print cartridge.

A further pushing of ink refill system 80 against print cartridge 10 causes sleeve 88 to slide up valve 86, as shown in FIG. 12, so that hole 90 in valve 86 is now in fluid communication with ink bag 32. The outer diameter of valve 86 is such that it forms a tight seal with respect to ink fill hole 28.

The negative pressure internal to ink bag 32 now automatically draws ink 95 through hole 90 from the external ink reservoir into ink bag 32 until either ink bag 32 is completely full or an equilibrium exists between the negative pressure in ink bag 32 and any negative pressure within the external ink reservoir 82 (FIG. 8). If there is no positive pressure provided by ink refill system 80, ink bag 32 will not become overfilled so that ink drooling from nozzles 24 (FIG. 1) is prevented.

Figure 13:
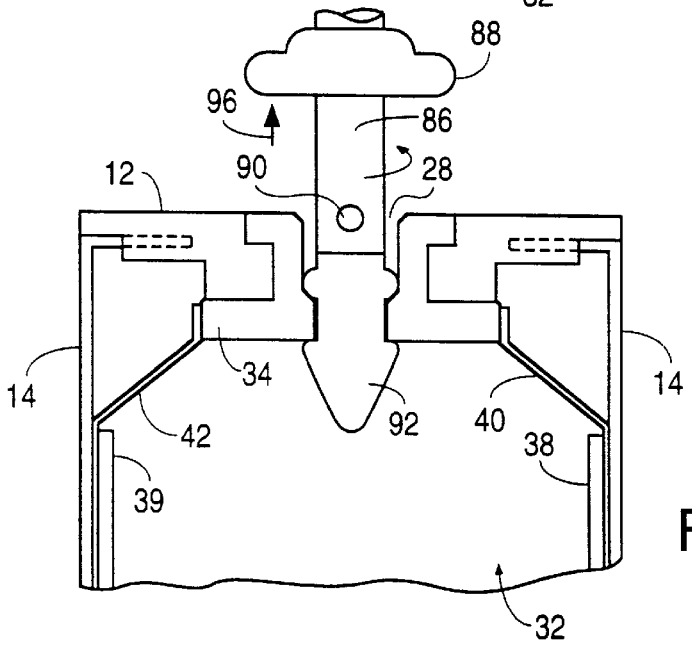

As shown in FIG. 13, valve 86 is then pulled away from print cartridge 10, as shown by arrow 96, so as to seat valve tip 92 within ink fill hole 28. Ink refill system 80 is then turned counter-clockwise so as to release valve 86 from tip 92. The friction created between tip 92 and the resilient frame 34 defining ink fill hole 28 prevents tip 92 from turning.

Figure 14:
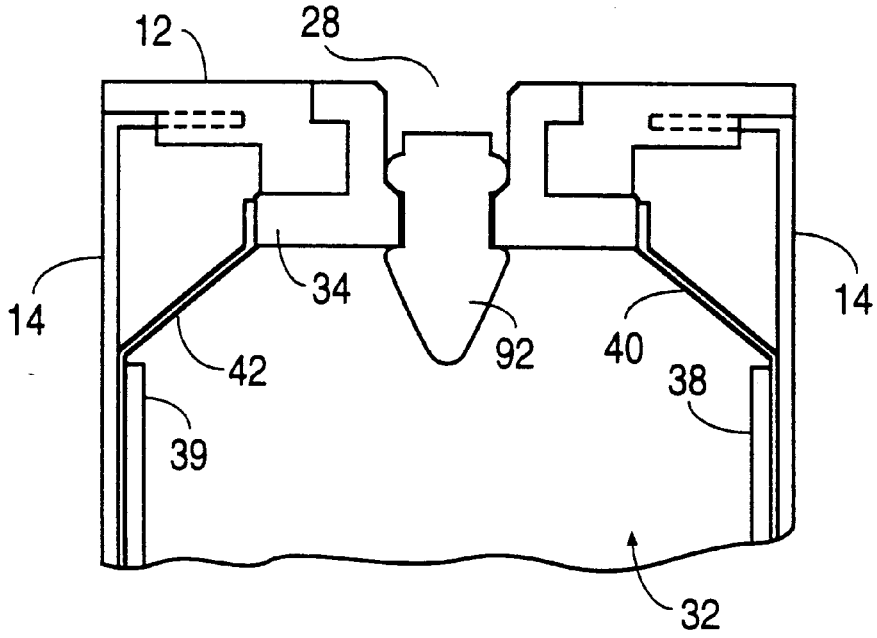

As shown in FIG. 14, ink refill system 80 has been completely removed leaving only valve tip 92 completely sealing ink fill hole 28. For a next recharge of print cartridge 10, the user may simply thread the end of valve 86 into the inner threads of valve tip 92 and again recharge ink bag 32, as shown in FIG. 12. Alternatively, a new ink refill system already containing tip 92 may be inserted through ink fill hole 28 and push the old tip 92 into ink bag 32, similar to pushing ball 74 into ink bag 32. Thus, the same valve tip 92 may be reused many times or a new valve tip 92 may be used while pushing the old valve tip into ink bag 32. Hence, ink refill system 80 in FIG. 8 may contain a supply of ink for either one recharge or a number of recharges of print cartridge 10.

If ink refill system 80 contains a number of recharges, rubber sleeve 88 may be spring-mounted onto valve 86 so as to automatically cover hole 90 as the ink refill system 80 is removed from print cartridge 10.

The print cartridge 10, as provided by the manufacturer, may have a valve tip 92 initially blocking fill hole 28 instead of using a steel ball 74. In such a case, the ink refill system does not need to be provided with its own valve tip 92.

In one embodiment, the external ink reservoir 82 includes a flaccid bag containing ink and having no air within the flaccid bag. The amount of ink in the flaccid bag is less than the capacity of ink bag 32 so that the flaccid bag will be completely depleted prior to ink bag 32 being completely full. Thus, a negative pressure will remain in ink bag 32, and there will be no leakage from hole 90 when ink refill system 80 is removed from print cartridge 10.

Figure 15:
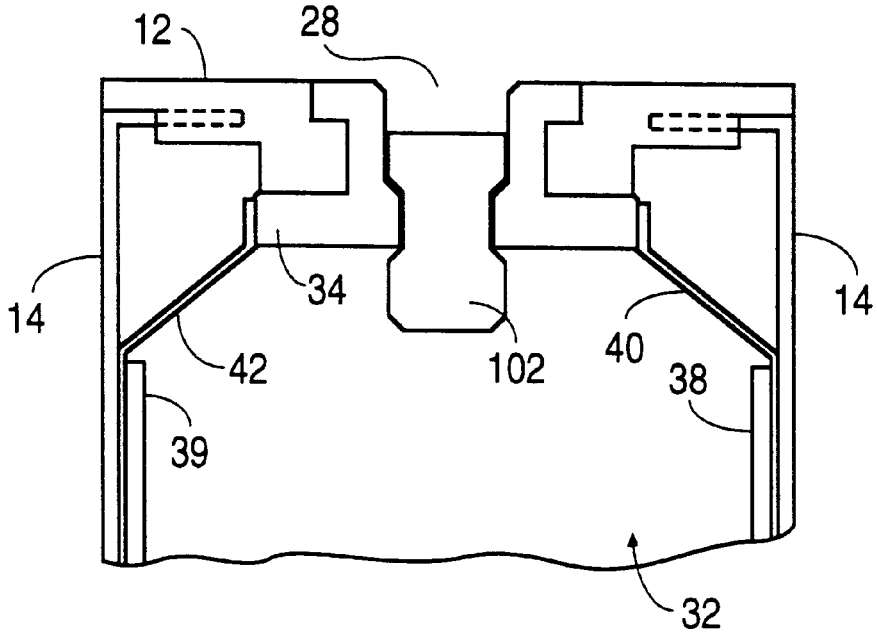
FIG. 15 illustrates another design for the valve tip.

FIG. 15 is a cross-sectional view along line 5—5 in FIG. 1 showing a different form of valve tip 102 to illustrate that there are many suitable shapes of valve tips which may be used with any of the ink refill systems described herein.

Thus, an ink refill system has been described for creating a resealable airtight fluid communication path between ink bag 32 in print cartridge 10 and the external ink supply connected to the ink refill system valve 86. The concepts described with respect to FIGS. 8–14 may be utilized in a number of embodiments of ink refill systems described below.

Figure 16:
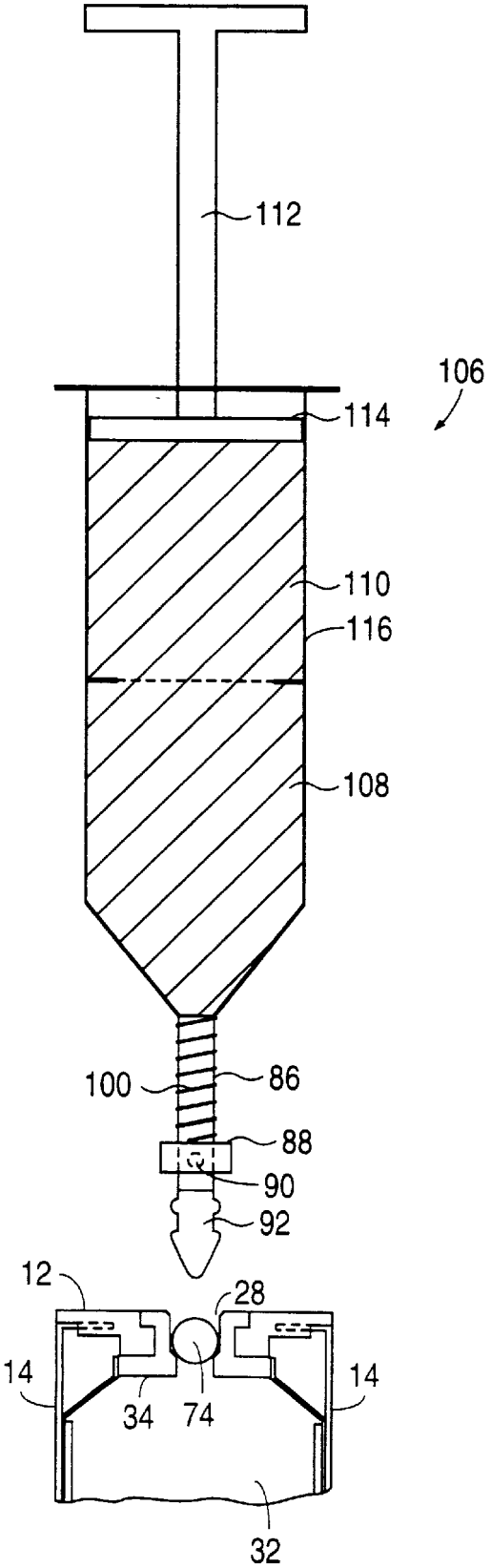
FIGS. 16, 17, 18, and 19 illustrate an embodiment of a syringe-type ink refill system for use with the print cartridge of FIG. 1.

A second embodiment ink refill system 106 is shown in FIG. 16 which contains two full ink recharges for print cartridge 10. A reusable valve tip 92 is shown mechanically coupled to valve 86. A spring-loaded rubber sleeve 88 blocks hole 90 (obscured by sleeve 88 and shown in dashed outline). Spring 100 is shown.

When recharging print cartridge 10, valve 86 is inserted into ink fill hole 28 in print cartridge 10 in the manner described with respect to FIG. 11. It is assumed that the original steel ball 74 is blocking ink fill hole 28. The two recharges of ink within ink refill system 106 are shown as first shot 108 and second shot 110. A plunger 112 has a seal 114 which slidably engages the sides of the ink reservoir 116.

Figure 17:
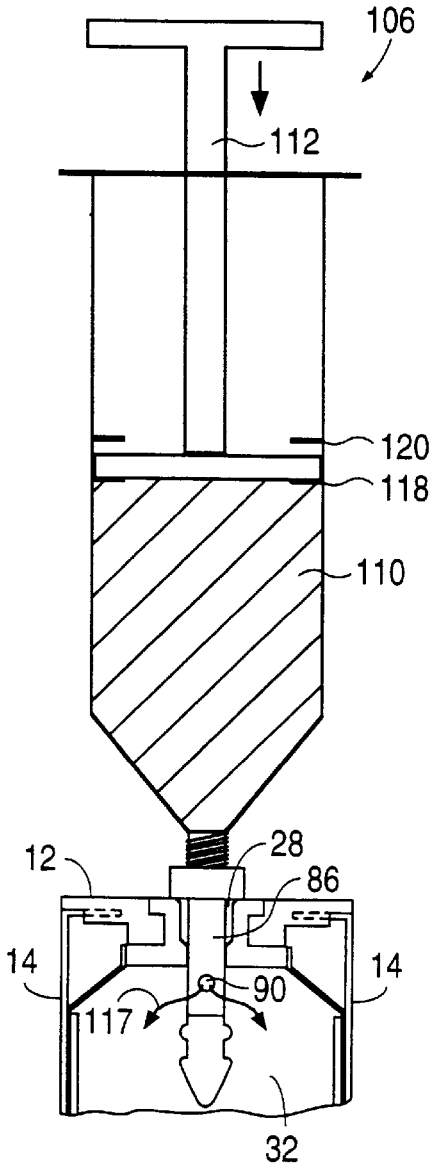

In FIG. 17, valve 86 is inserted through ink fill hole 28 to dislodge steel ball 74 and create an airtight fluid communication path between the ink in ink bag 32 and the ink in ink reservoir 116 via hole 90 formed in valve 86. Although a negative pressure in ink bag 32 provides a force to draw ink 117 from ink reservoir 116, pressing plunger 112 downward accelerates this transfer of ink into ink bag 32. Plunger 112 is pressed into ink reservoir 116 until the bottom portion of seal 114 aligns with a particular grid marking 118 on the side of ink reservoir 116. At this time, ink bag 32 is substantially full.

To ensure a minimum back pressure in ink bag 32, plunger 112 is then pulled out of ink reservoir 116 a predetermined amount to match another grid marking 120 so as to pull a predetermined volume of ink out of ink bag 32 to ensure a minimum negative pressure within ink bag 32.

Figure 18:
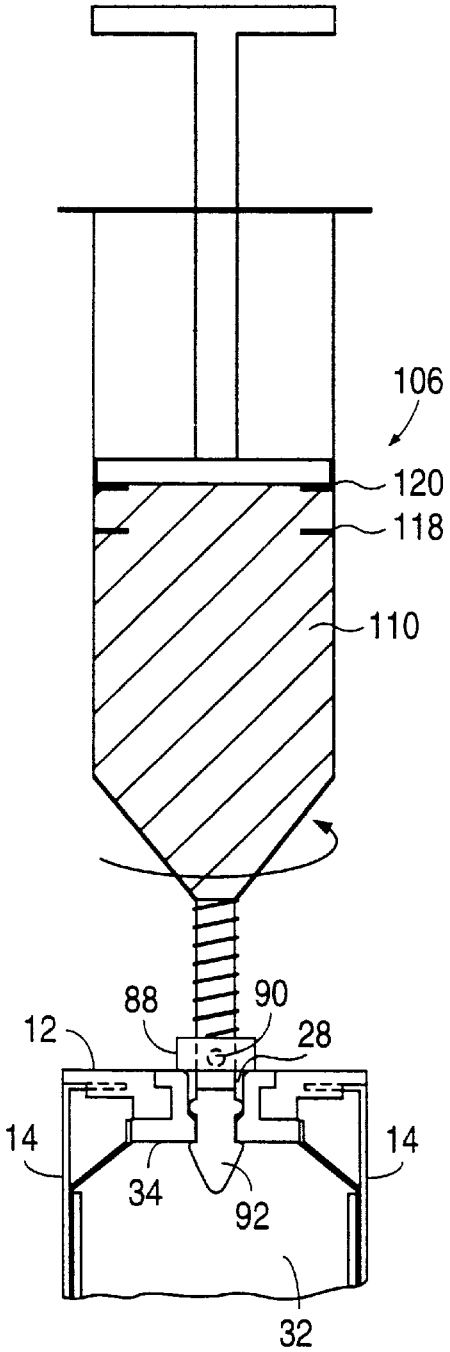

As shown in FIG. 18, ink refill system 106 is then partially pulled out of ink fill hole 28 until valve tip 92 seats within ink fill hole 28. The spring-loaded sleeve 88 again covers hole 90 to prevent ink leakage. Ink refill system 106 is then turned in a counter-clockwise direction to decouple the end of valve 86 from valve tip 92. Preferably, the screw threads 94 (FIG. 19) coupling valve 86 to valve tip 92 require three turns or less to decouple tip 92 from valve 86.

Figure 19:
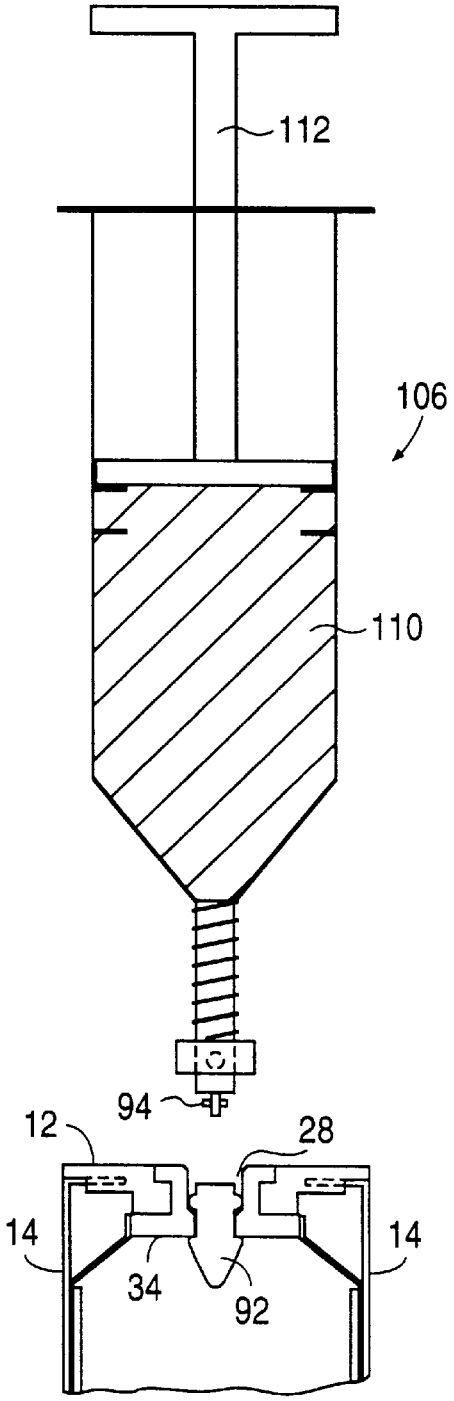

FIG. 19 shows ink refill system 106 now completely removed from print cartridge 10 and valve tip 92 remaining in ink fill hole 28. As seen, the second shot 110 remains in ink refill system 106 for a next recharge of print cartridge 10 using the same valve tip 92.

Incorporating fins or other types of gripping mechanisms on the surface of valve tip 92 may be used to provide additional friction between valve tip 92 and the resilient plastic frame 34 defining ink fill hole 28. Ink refill system 106 may be provided with three or more charges in alternative embodiments.

In all embodiments, care must be taken to prevent any air ingestion into ink bag 32 and to prevent overfilling of ink bag 32.

Figure 20:
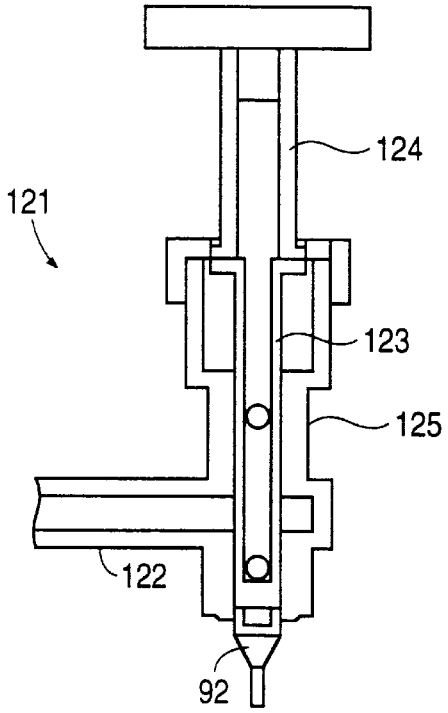
FIG. 20 is a cross-sectional view of another embodiment ink refill system.

FIG. 20 is a cross-sectional view of the valve portion of another ink refill system 121 where a supply of ink is connected via a tube 122 at a substantially 90° angle with respect to the male valve 123. In this embodiment, no plunger is used to accelerate ink from the ink supply into the ink bag 32, but a plunger 124 of a small size is used to insert valve 123 into print cartridge 10. A body 125 provides a seal around valve 123.

Ink refill system 121 is then placed on print cartridge 10 so that valve tip 92 is inserted into the ink fill hole 28. If another tip 92 resided in ink fill hole 28 from a previous recharge of print cartridge 10, then the threaded end of valve 123 would be inserted into the tip 92, and plunger 124 would be turned in a clockwise direction to mechanically couple the end of male valve 123 into the end of tip 92.

Figure 21:
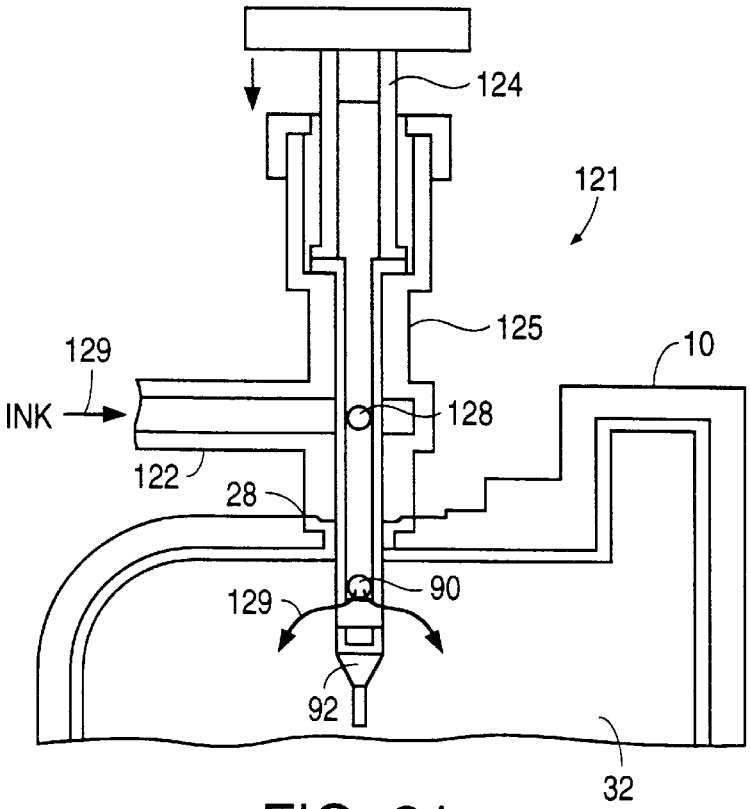
FIG. 21 is a cross-sectional view of the print cartridge of FIG. 1 along line 20—20 in FIG. 1 while being recharged by the ink refill system of FIG. 20.

In FIG. 21, plunger 124 is pressed down so that hole 90 in valve 86 is now located in ink bag 32 and upper hole 128 communicates with pipe 122. The negative pressure in ink bag 32 then draws ink 129 from the external ink reservoir through pipe 122, through hole 128, and out of hole 90 into ink bag 32 until the external ink reservoir has been emptied or the negative pressure in ink bag 32 is at equilibrium with any internal pressure in the external ink reservoir.

Plunger 124 is then lifted to seat valve tip 92 within ink fill hole 28 and turned in a counter-clockwise direction to release the ink refill system 121 from the valve tip 92.

Figure 22:
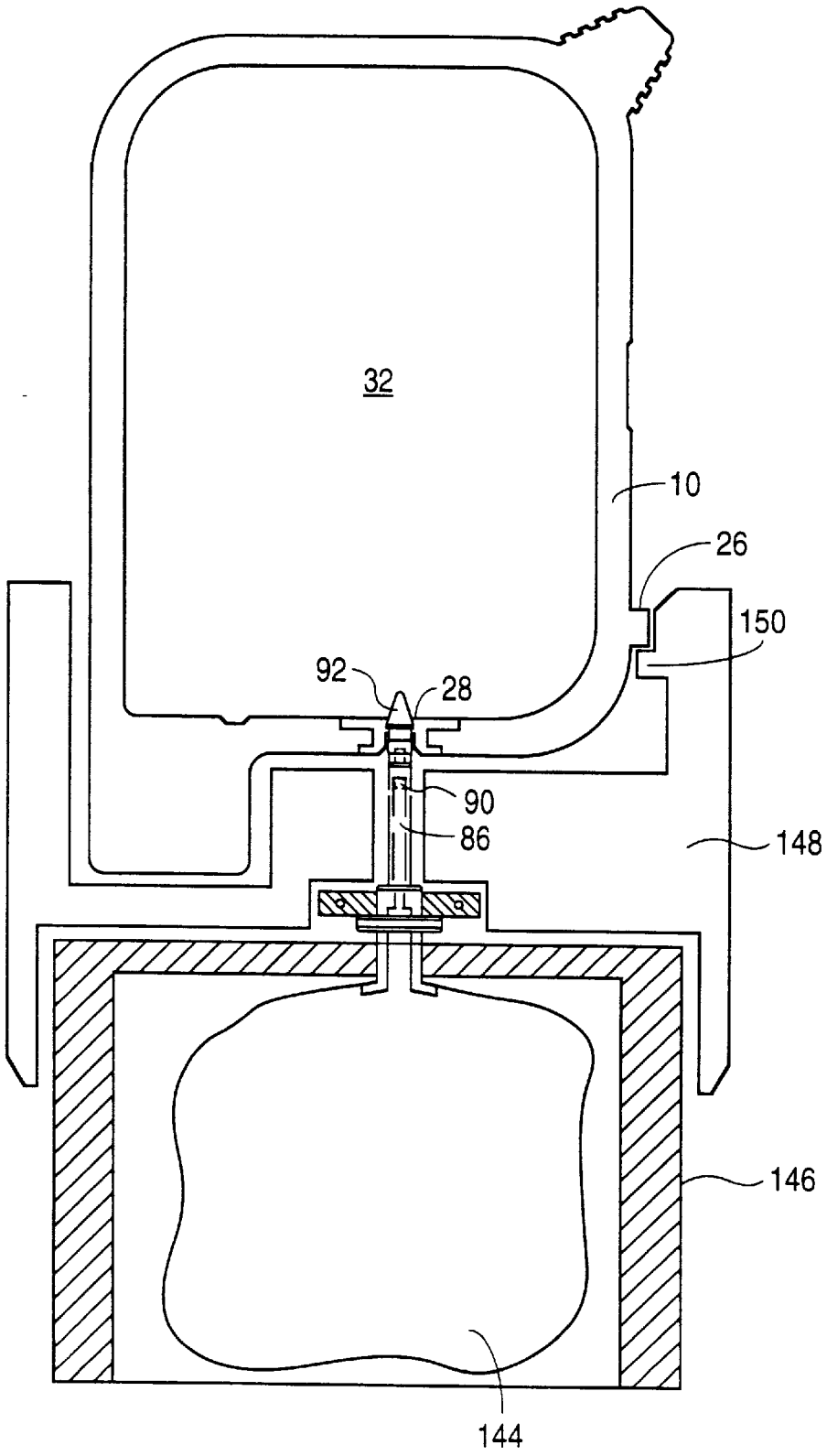
FIG. 22 is a cross-sectional view of the print cartridge of FIG. 1 along line 20—20 in FIG. 1 illustrating the recharging of the print cartridge using a valve connected to a flaccid bag containing ink and using a rotatable print cartridge support.
Figure 23:
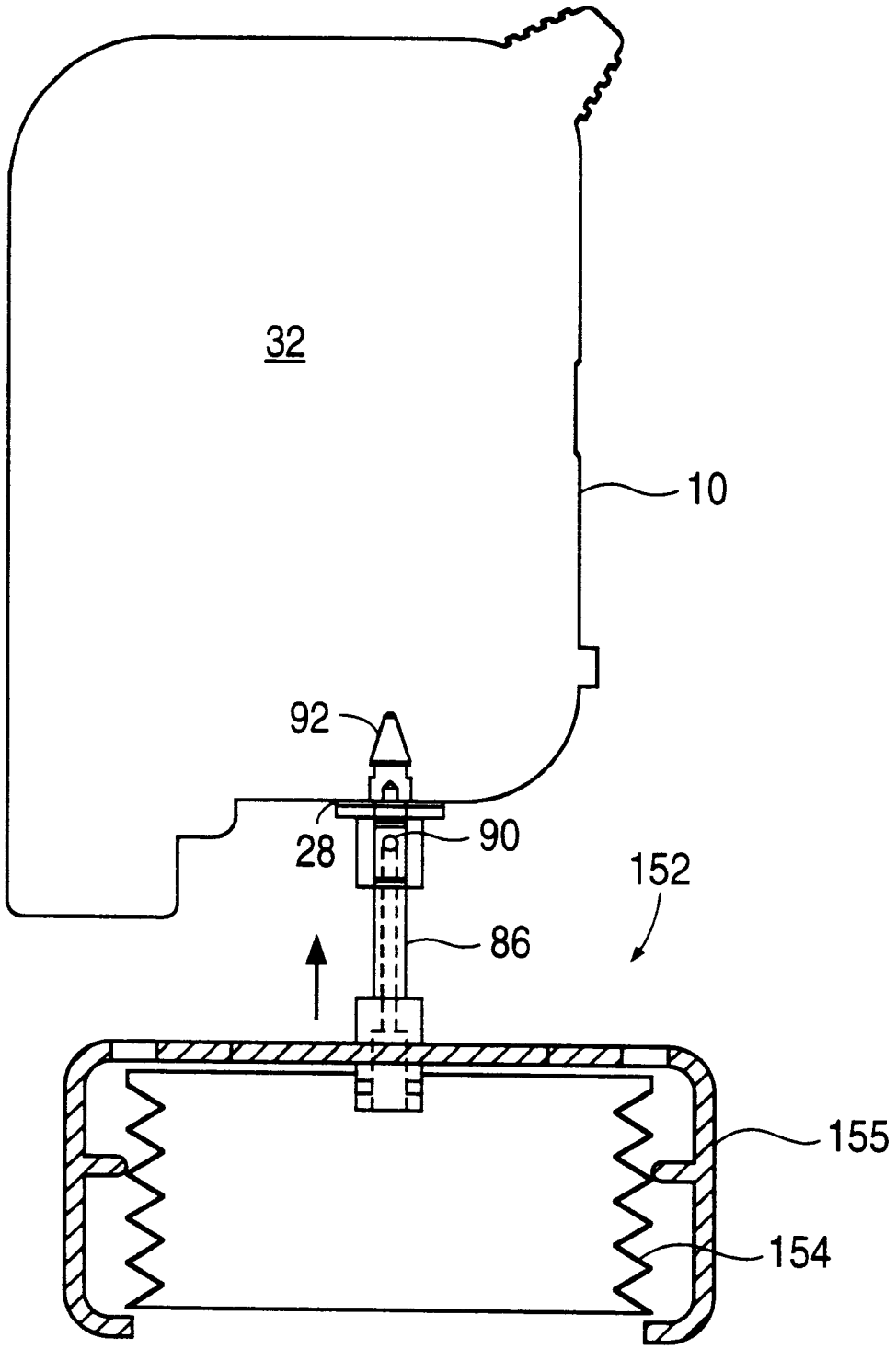
FIGS. 23 and 24 are cross-sectional views of the print cartridge of FIG. 1 along line 20—20 in FIG. 1 illustrating the recharging of the print cartridge using a valve connected to a compressible bellows.
Figure 24:
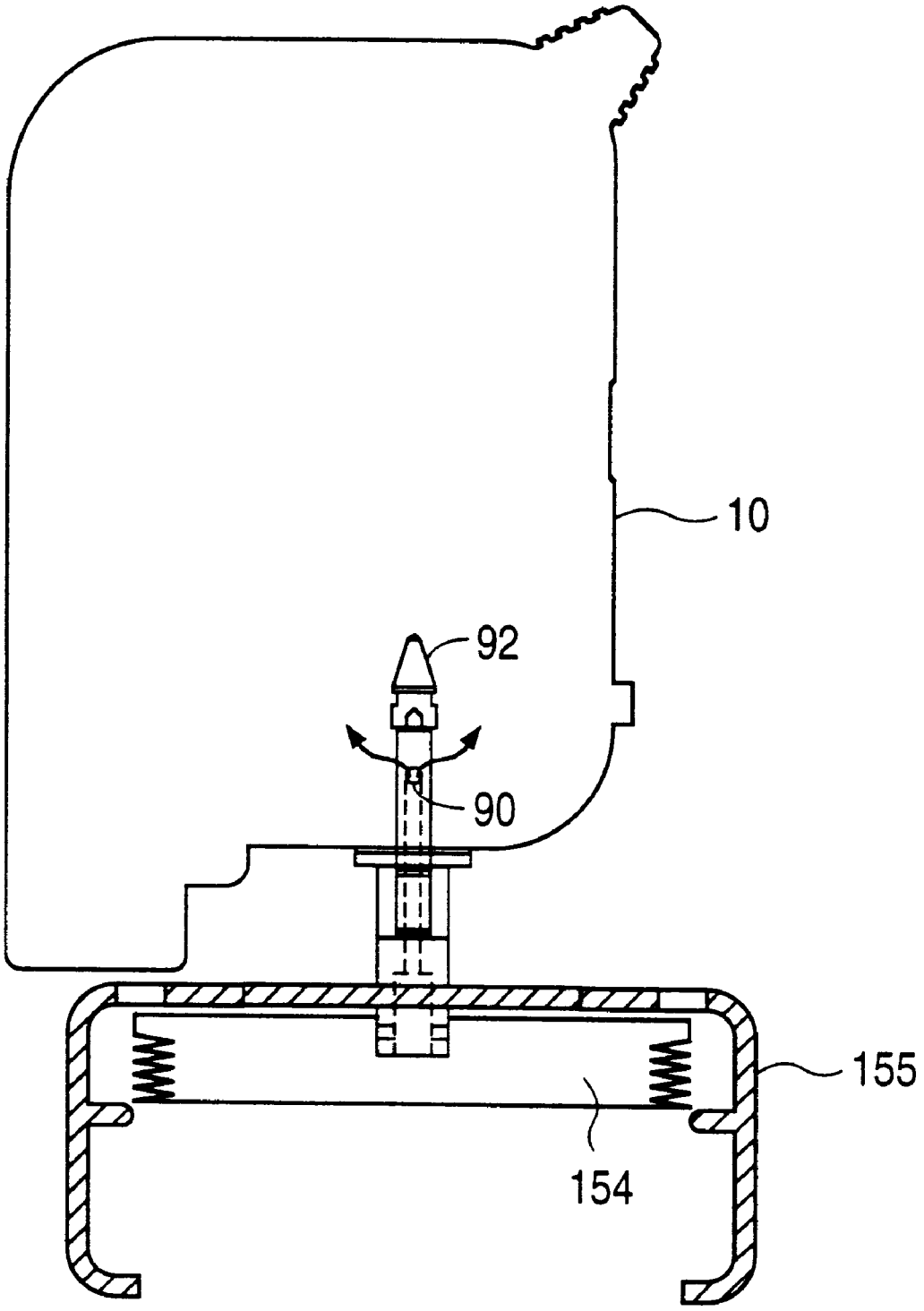

FIGS. 22–24 are cross-sectional views illustrating external ink reservoirs which may be used with any of the valve embodiments previously described.

In FIG. 22, a flaccid bag 144 containing a supply of ink is housed in a rigid base 146. Valve 86, previously described, has its central bore in fluid communication with the ink within flaccid bag 144. A rotatable support 148 rests on top of base 146 and receives print cartridge 10 so that print cartridge 10 is in a predetermined optimal position with respect to valve 86. Tabs 26 on print cartridge 10, described with respect to FIG. 1, slide between slots 150 on support 148 to ensure that the black, yellow, magenta, or cyan print cartridges (each having a unique combination of tabs 26) receive the proper color ink. Hence, refill systems for each color ink would have a different arrangement of slots 150.

Once print cartridge 10 is properly placed within support 148, support 148 and print cartridge 10 are rotated in a clockwise direction to engage valve tip 92 with the end of valve 86, assuming valve tip 92 was already seated within ink fill hole 28 in print cartridge 10.

Print cartridge 10 is then further pushed down on base 146 to cause valve tip 92 to unseat from ink fill hole 28 and to cause hole 90 to then be located within ink bag 32. This may be done by providing a gap between the bottom of support 148 and the top of base 146 with a spring urging support 148 a first distance away from base 146. When support 148 is pressed against the top of base 146, a latch (or other engaging means) then engages base 146 and support 148 to maintain this recharge position until recharging is complete. The negative pressure within ink bag 32 in print cartridge 10 draws ink from flaccid bag 144 until flaccid bag 144 is empty or an equilibrium is achieved between the negative pressure in ink bag 32 and the downward pressure of the ink within the ink column below print cartridge 10. Thus, a minimum negative pressure will remain within ink bag 32.

After recharging, the latch is triggered so that valve tip 92 is again seated within fill hole 28. Print cartridge 10 and support 148 are then rotated counter-clockwise to mechanically decoupled valve tip 92 from the ink refill system.

FIG. 23 is a cross-sectional view illustrating an ink refill system where the external ink reservoir consists of a bellows 154 having either an internal spring or a corrugated exterior which urges the bellows 154 to be in an extended state. Thus, bellows 154 has a negative internal pressure. A rigid base 155 supports bellows 154 and valve 86.

Valve 86 and valve tip 92 are inserted into ink fill hole 28 as shown in FIG. 24 and described with respect to the other embodiments. The negative pressure within ink bag 32 in print cartridge 10 then draws ink from bellows 154 and through hole 90 until the negative pressures in ink bag 32 and in bellows 154 are equal, at which time the transfer of ink automatically ceases. Base 155 may be used to support print cartridge 10 during the recharging process. The optimum negative pressure in bellows 154 depends upon the intended position of bellows 154 with respect to print cartridge 10 during refilling. For example, if bellows 154 is intended to be above print cartridge 10 while recharging, bellows 154 must be provided with a greater negative internal pressure than if bellows 154 were to be located below print cartridge 10 during recharging.

FIG. 24 illustrates the compressed bellows 154 after recharging. In the preferred embodiment, the amount of ink in bellows 154 is on the order of 40 cubic centimeters, and the depth of bellows 154 is on the order of two centimeters.

If the amount of ink in bellows 154 is less than the capacity of ink bag 32, bellows 154 may be manually compressed without fear that ink bag 32 will become overfilled.

Figure 25:
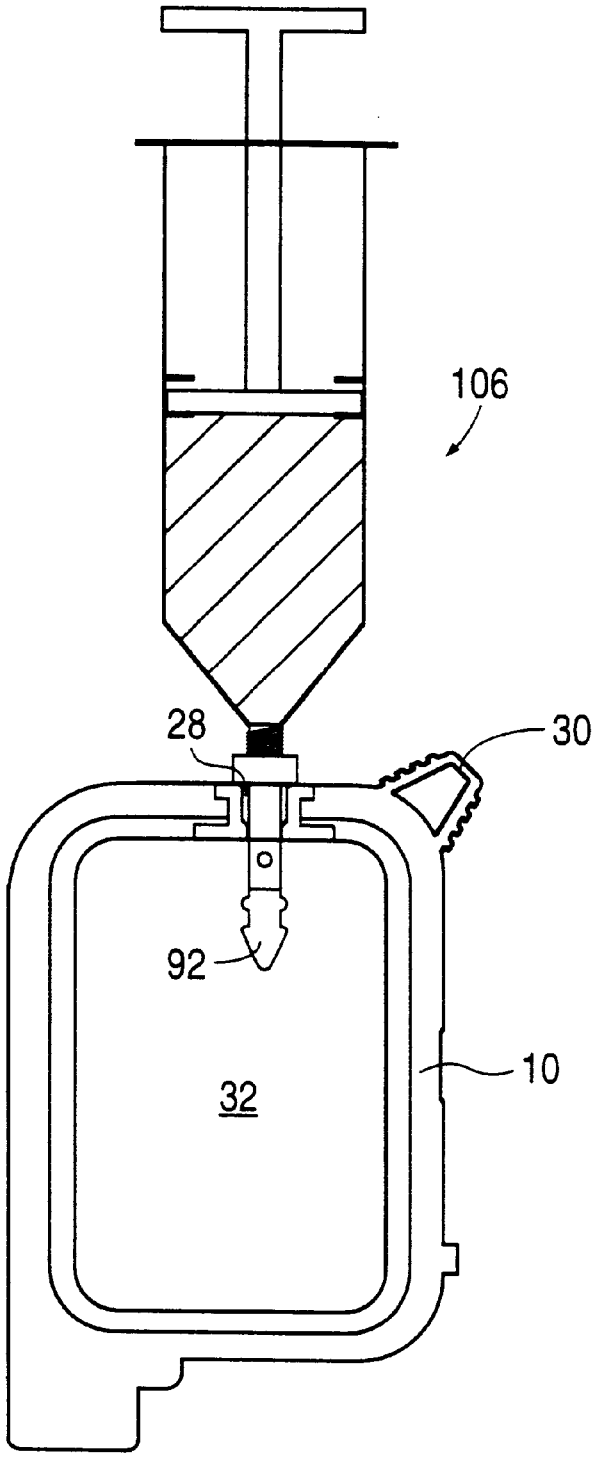
FIG. 25 is a cross-sectional view of a print cartridge illustrating the recharging of the print cartridge through an ink fill hole which is accessible when the print cartridge is installed in a printer.

FIG. 25 is a cross-sectional view illustrating recharging of print cartridge 10 using ink refill system 106, described with respect to FIG. 16, where the ink fill hole 28 is located at a different location on print cartridge 10. This ink fill hole may be in addition to the ink fill hole described with respect to FIG. 1. When print cartridge 10 is installed in a conventional carriage, the location of ink fill hole 28 in FIG. 1 is blocked by the ink printer and the carriage so that print cartridge 10 would have to be removed from the ink printer for recharging. If an ink fill hole 28 were located in handle 30 or along the back or top of print cartridge 10, ink fill hole 28 would then be accessible while print cartridge 10 was installed in a carriage. Print cartridge 10 can then be recharged without removing print cartridge 10 from the carriage. Such recharging may take place either continuously, intermittently, or when ink bag 32 is substantially depleted of ink.

The ink refill technique shown in FIG. 25 is identical to that shown in FIGS. 16–18, and the description will not be repeated. Identical numerals in the figures refer to identical structures. Numerous structures may be used in conjunction with the ink recharge techniques described herein to ensure that the male valve 86 is substantially perpendicular with respect to ink fill hole 28. This ensures an airtight seal and prevents breaking or bending of the male valve 86. Other designs may ensure that the valve 86 system is mechanically coupled to the valve tip 92 prior to the valve tip 92 being pushed into ink bag 32.

Figure 26:
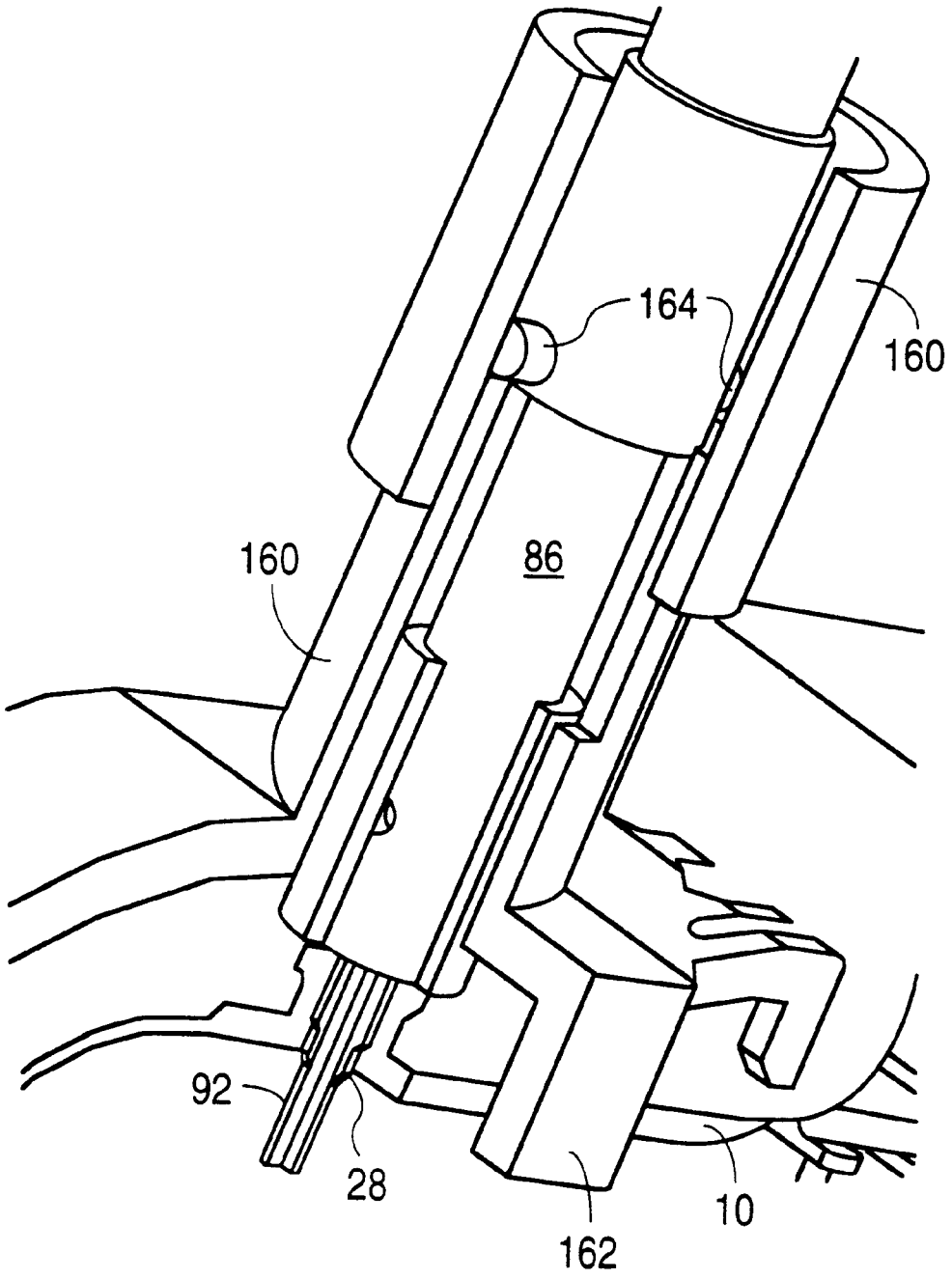
FIG. 26 is a partial cut-away view of a guide sleeve and support for the ink refill system valve when connected to the print cartridge.

FIG. 26 is a cut-away view of valve 86 engaging a guide sleeve 160 which has a support portion 162 resting on print cartridge 10 to ensure that sleeve 160 is substantially perpendicular to ink fill hole 28. Knobs 164 extending from valve 86 are blocked by stops on sleeve 160 when valve 86 is forced downward unless valve 86 is turned one-quarter turn to engage valve tip 92. Numerous other embodiments for such a guide means and inadvertent decorking mechanism may be devised. Support portion 162 may also contain slots for interacting with tabs 26 (FIG. 1) on print cartridge 10 to ensure that the correct ink refill system is connected to the proper print cartridge 10.

Conclusion

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention. For example, although a negative pressure ink bag 32 is described, a negative pressure ink bag 32 may not be necessary. The ink bag 32 in print cartridge 10 will be refilled as long as the refill ink supply is at a pressure greater than the pressure in the ink bag. Such a pressure differential may be obtained by raising the external ink supply above the print cartridge or providing the external ink supply with an internal positive pressure. The external ink reservoir may take any form and may be a flaccid bag or a rigid vessel which may be vented or non-vented. Positive or negative pressure may be achieved using a spring bag, a bellows, a balloon, a syringe, a pressure regulator in series with the external ink reservoir and the print cartridge, or any other known technique.

What is claimed is:

1. A recharging system for an inkjet cartridge having plug for sealing a refill hole in the cartridge comprising:

a valve tip having a sufficient hardness to dislodge the plug into an internal ink receiving chamber within the inkjet cartridge as the valve tip is moved to a chamber filling position within the chamber and a sufficient softness to seal the ink fill hole of the inkjet cartridge when the valve tip is subsequently moved to a cartridge refill hole sealing position; and a fluid interconnect releasably secured to said valve tip to facilitate refilling the inkjet cartridge with a predetermined volume of ink without any substantial air ingestion said fluid interconnect being in fluid communication with a supply of ink for refilling the inkjet cartridge without any substantial loss of back pressure when said fluid interconnect is moved in one direction to cause said valve tip to move to said chamber filling position and for retracting said valve tip from said internal ink receiving chamber without any substantial loss of back pressure when said fluid interconnect is moved in an opposite direction to a disconnect position where the valve tip is positioned in said refill hole sealing position.

2. A refilling system for a print cartridge having an ink fill hole, comprising:

a valve tip for helping to couple the print cartridge in fluid communication with a supply of ink, said value tip being configured to seal the ink fill hole when received therein for cartridge refilling purposes; and an elongated hollow needle having one of its ends configured to be releasably coupled in fluid communication with the supply of ink and the other one of its end configured to be releasably coupled in fluid communication with said valve tip so that ink can pass thereto to facilitate the refilling of the print cartridge through the ink fill hole.

3. A method for recharging a print cartridge having a fill hole, comprising:

providing a valve tip for helping to couple the print cartridge in fluid communication with a supply of ink, said value tip being configured to seal the ink fill hole when received therein for cartridge refilling purposes; and providing an elongated hollow needle having one of its ends configured to be releasably coupled in fluid communication with the supply of ink and the other one of its end configured to be releasably coupled in fluid communication with said valve tip so that ink can pass there through to facilitate the refilling of the print cartridge through the ink fill hole;

inserting one end of said hollow needle through the ink fill hole and into an ink chamber within said print cartridge;

inserting another end of said hollow needle into said valve tip such that said valve tip is residing within said ink chamber after the other end is inserted through said ink fill hole; and transferring ink from said ink reservoir, through said hollow needle, through a first opening in said hollow needle, and into said ink chamber within said print cartridge.

4. A method according to claim 3, further comprising:

withdrawing said hollow needle from said ink chamber until said valve tip seats within said ink fill hole to seal said ink chamber, said valve tip having an outer surface shape which seals said ink fill hole.

5. The method of claim 4 wherein the step of withdrawing includes:

disengaging said one end from said valve tip; and wherein said supply of ink includes an ink reservoir for holding a quantity of liquid ink, said ink reservoir having a tube substantially perpendicular to said hollow needle, wherein an opening of said tube aligns with said first opening to cause fluid communication between the central passageway in said hollow needle and said ink reservoir.

6. The method of claim 4 wherein said ink reservoir is a flaccid bag.

7. The method of claim 4 wherein said ink reservoir is a bellows.

8. The method of claim 4, wherein said hollow needle has an outer surface and a central passageway, wherein a first hole is formed in said hollow needle between said outer surface and said central passageway proximate to said another end, and wherein said step of inserting the another end through the fill hole comprises the step of inserting said another end sufficiently far through the fill hole so that said first hole is located within said ink chamber.

* * * * *